United States Patent [19]

Yon

[11] Patent Number: 4,757,572

[45] **Date of Patent: * Jul. 19, 1988**

[54] WALL CORNER FINISHING TOOL

[76] Inventor: Gary Yon, 8495 Remington Dr., Pittsburgh, Pa. 15237

[ * ] Notice: The portion of the term of this patent subsequent to Oct. 21, 2003 has been disclaimed.

[21] Appl. No.: 922,531

[22] Filed: Oct. 23, 1986

Related U.S. Application Data

[63] Continuation-in-part of Ser. No. 769,163, Aug. 23, 1985, Pat. No. 4,619,013.

[51] Int. Cl.[4] ..... B05C 17/10

[52] U.S. Cl. ..... 15/235.7; 15/235.8; 425/458

[58] Field of Search ..... 15/235.3, 235.4, 235.5, 15/235.6, 235.7, 235.8, 236 R, 105.5; 425/458; D8/10, 45

[56] References Cited

U.S. PATENT DOCUMENTS

| | | | |
|---|---|---|---|
| 1,241,577 | 10/1917 | Thompson | 15/236 R |
| 2,178,899 | 11/1939 | Shaffer | 15/235.7 |
| 2,595,742 | 5/1952 | Wood, Jr. | 15/235.7 |
| 2,608,853 | 9/1952 | Shrepper | 15/235.7 |
| 2,616,285 | 11/1952 | Shields | 15/235.7 |
| 2,906,442 | 9/1959 | McNutt | 223/94 |
| 3,932,101 | 1/1976 | Johnson et al. | 15/235.7 |

FOREIGN PATENT DOCUMENTS

| | | | |
|---|---|---|---|
| 2825338 | 12/1979 | Fed. Rep. of Germany | 15/235.7 |
| 2226532 | 11/1974 | France | 15/235.7 |

*Primary Examiner*—Harvey C. Hornsby
*Assistant Examiner*—Joseph S. Machuga
*Attorney, Agent, or Firm*—Reed Smith Shaw & McClay

[57] ABSTRACT

Accordingly, there is provided a hand finishing tool for dry wall board installation consisting of three operative components: a main body comprising a planar sheet material formed into two substantially flat sides extending radially from the common line to define a dihedral configuration; a manual tool gripping means pinned at its stem end to the inner surface of the main body; and a tool angle biasing means adapted, upon digital manipulation, to outwardly bias the flat sides to temporarily enlarge during tool use the angle that the sides normally define.

5 Claims, 5 Drawing Sheets

WALL CORNER FINISHING TOOL

CROSS REFERENCE TO OTHER APPLICATIONS

This is a continuation-in-part of my copending application Ser. No. 769,163, filed Aug. 23, 1985, now U.S. Pat. No. 4,619,013, issued Oct. 28, 1986.

FIELD OF THE INVENTION

This invention relates to a finishing tool for installers of dry wall boards and providing square corner finishes.

BACKGROUND OF THE INVENTION

Hand tools called plasterer's trowls and plows have long been available for smoothing and shaping wet plaster in the corners defined by the adjacent walls of a room. See U.S. Pat. No. 3,079,622, issued Mar. 5, 1963. Such tools are not successfully adaptable to the more currently used dry wall installation approach. A present need is the provision of a trimming tool which will blend the wet filling plaster and the corner ceiling tapes now employed. Such is needed to finish smoothly the corners of dry constructed building walls formed of rigid but shapable wall board with a minimum of manual labor so as to effect an esthetically pleasing seam as to adjoining wall boards. One approach to this construction need is described in U.S. Pat. No. 2,616,285 to S. T. Shields, issued Nov. 4, 1952.

OBJECT OF THE INVENTION

The principal object of the invention is to provide a finishing tool for wall board installers which can be used with facility to consistently seal and smooth the abutting corners of dry wall board after their installation. A further object is to provide a manually adjustable, dual-bladed tool for the prime object stated, which will form substantially accurate taped corners while effecting a feather edged joint between the converging hard panel board surfaces, thus eliminating much of the time spent by the installer in sanding down the plastered seal of the wall corners to gain the esthetic objective of a feather edge with the surfaces of the abutting panels.

SUMMARY OF THE INVENTION

Accordingly, there is provided a hand finishing tool for dry wall board installation consisting of three operative components: a main body comprising a planar sheet material formed into two substantially flat sides juxtaposed to one another and divergent from a common line to define a dihedral configuration, preferably at a uniform set angle, which is measurably greater than 90°; a manual tool gripping means pinned at its stem end to the inner surface of the main body and at its gripping end projecting rearwardly of the back edge of that body; and a tool biasing means operatively anchored to the stem of the gripping means and adapted, upon digital manipulation, to outwardly bias the flat sides to temporarily enlarge the angle that the sides normally define during tool use so as to aid in gaining the smooth surface effect of the sealing material being deposited into the wall board corners.

DETAILED DESCRIPTION OF THE INVENTION

Figure 1:
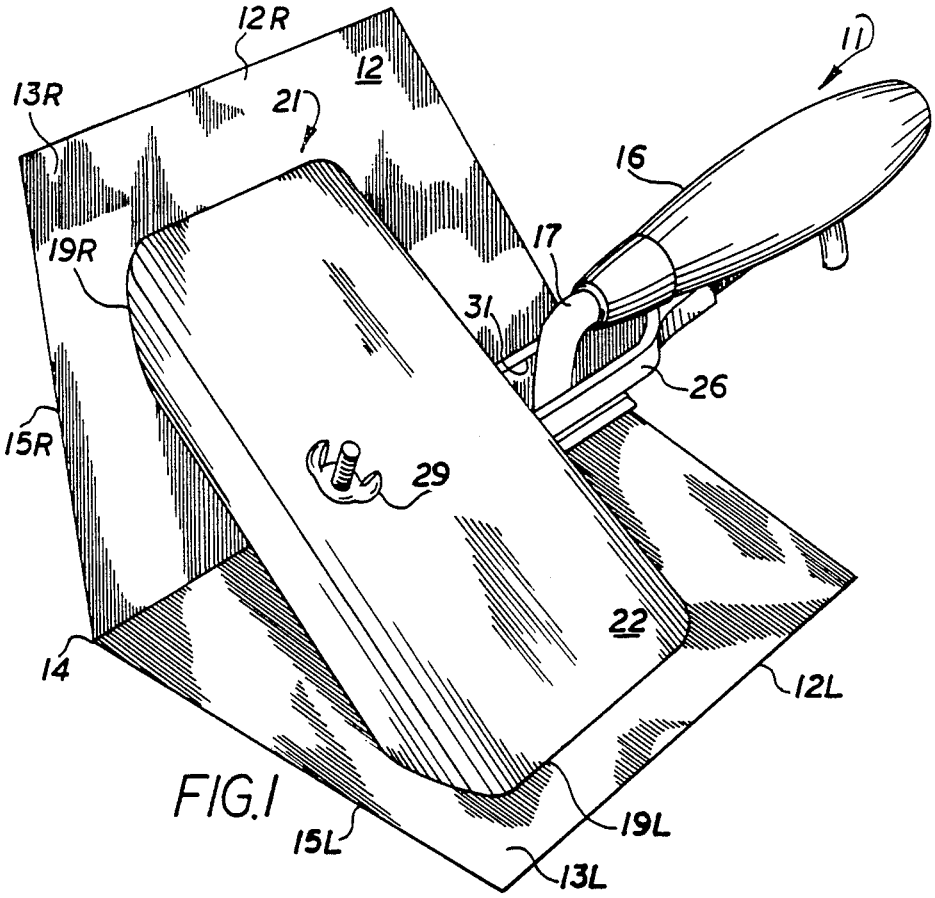
FIG. 1 is a perspective view of the forward end of a tool for the formation of inside corner joints on dry walls.
Figure 2:
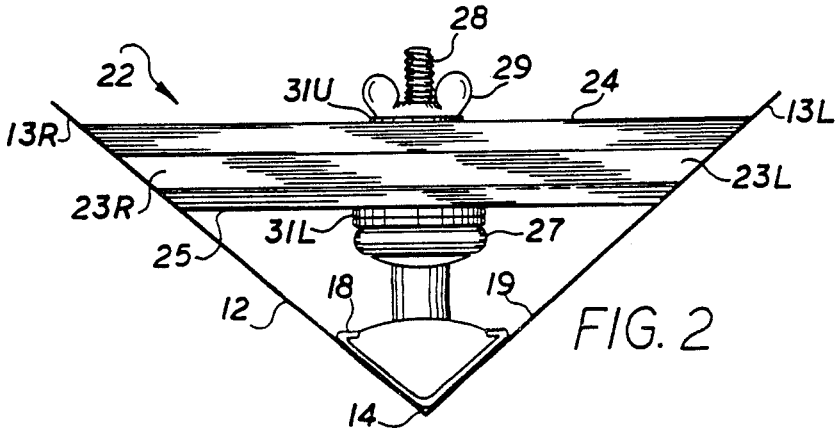
FIG. 2 is a forward end view of the tool shown in FIG. 1.

Referring now to the drawings, and to FIG. 1 in particular, there is shown a perspective view of the tool of the present invention specially adapted for finishing inside corner joints which are formed on dry wall construction. The body of the tool, generally 11, comprises a sheet of flexible metal 12 of about 0.15 to 0.25 inches in thickness. This sheet material has been pre-formed into two substantially flat sides, 13L and 13R, which are juxtaposed to one another and which extend radially from a common axis 14 to define a rather wide dihedral configuration when viewed from the forward end (FIG. 2). While installed wall boards abut mostly as squared corners (90° angles), the formed, but flexible, flat sides of the tool 11 have a normal angle appreciably greater than 90°. An operable range is between 95 and 125, but an optimum angle is thought to exist at about 100°.

The outer side surfaces 13 which contact the wall corners should preferably be of a polished metal (or coated) nature so that in use they will confer on the ceiling plaster and underlying tape a smooth surface and create a feather blend of ceiling tape with the abutting wall.

Figure 4:
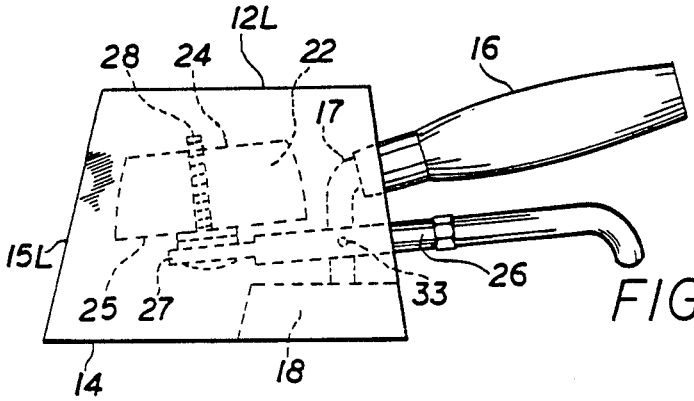
FIG. 4 is a side elevation of the tool shown in FIG. 1.

In FIG. 4, the side view further reveals how the forward edges 15 and 15 of the blade sides, respectively, incline backwardly and uniformly away from the trough 14 (or axis) of the tool body to the upper edges 12L and 12R. This feature serves to aid in spread of ceiling material while the tool is in operation finishing a corner.

Reverting again to FIG. 1, it will be seen that the gripping means, has a handle portion 16 of polished surface, or the like, joined with a rigid elbowlike shaft 17, the vertical leg of which terminates at fixed bracket 18. The latter seats in a fixed manner (by tack welding or the like), along the trough portion of the inner surface 19 of body 12. Grip 16 is usually disposed centrally thereof for achieving balanced application of corner pressure by the installer. The dihedral configuration of the bracket 18 is conformed to that of the inner blade surface 19 to assure durable anchoring to it. The vertical leg of shaft 17 of handle 16 is bored transversely along its intermediate portion to admit a horizontal pin (not seen) which supports, in a pivotal manner, the sides biasing assembly, generally 21.

Figure 6:
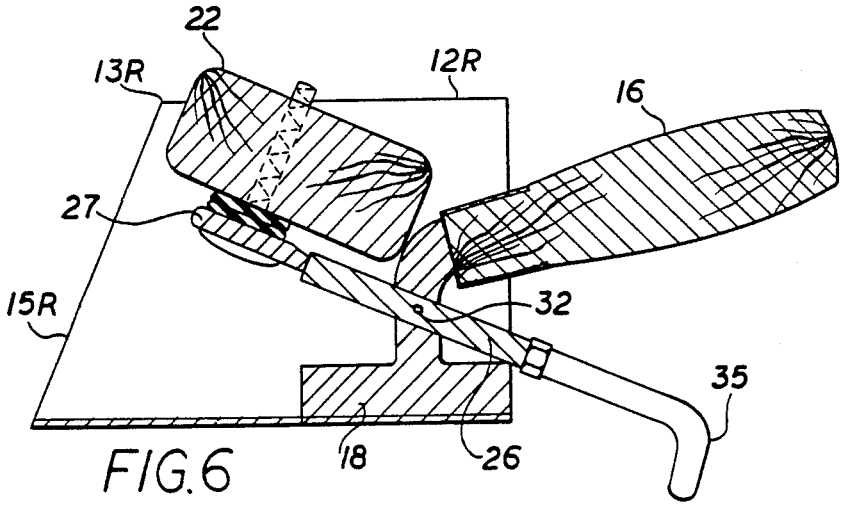
FIG. 6 is a cross-section elevation view taken substantially along the lines of 6—6 in FIG. 5.

It will be further seen from FIGS. 2 and 6, that the straddle block 22 makes an interruptable contact with the inner surfaces 19R and 19L of the tool. The horizontal extremities 23R and 23L (FIG. 2) of block 22 are beveled inwardly from their surfaces upper 24 to lower surface 25 as planar surfaces angle to conform substantially to the inner surface 19L and 19R, thereby permitting exertion a uniform pressure throughout the area of the biasing contact. When not in use, block 22 lies loosely cradled within the sides 19R and 19L, while remaining pinned to horizontal support bar 26.

Figure 3:
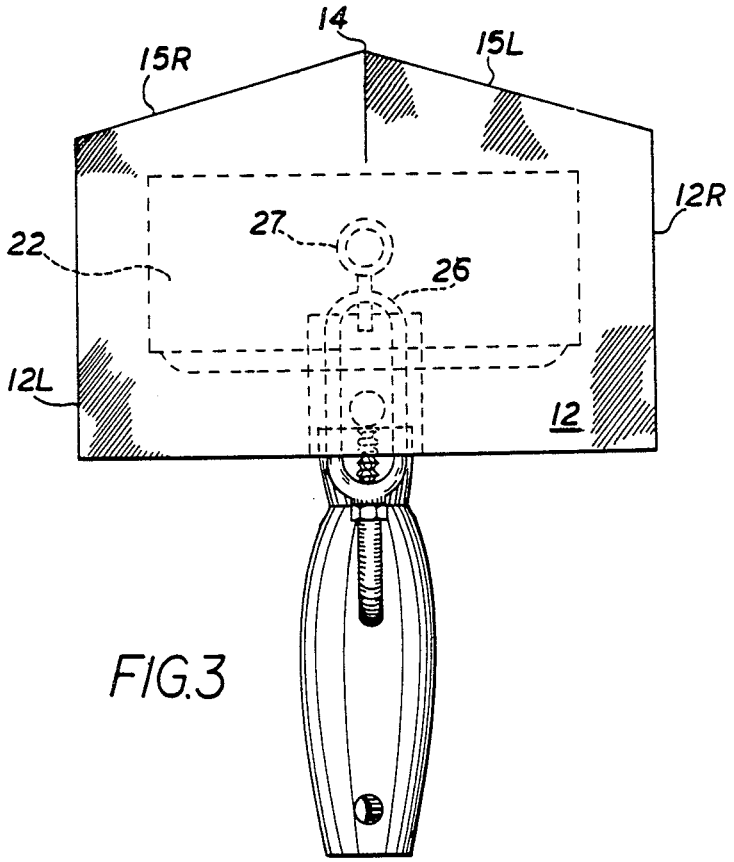
FIG. 3 is a under side elevation view of the tool shown in FIG. 1.
Figure 5:
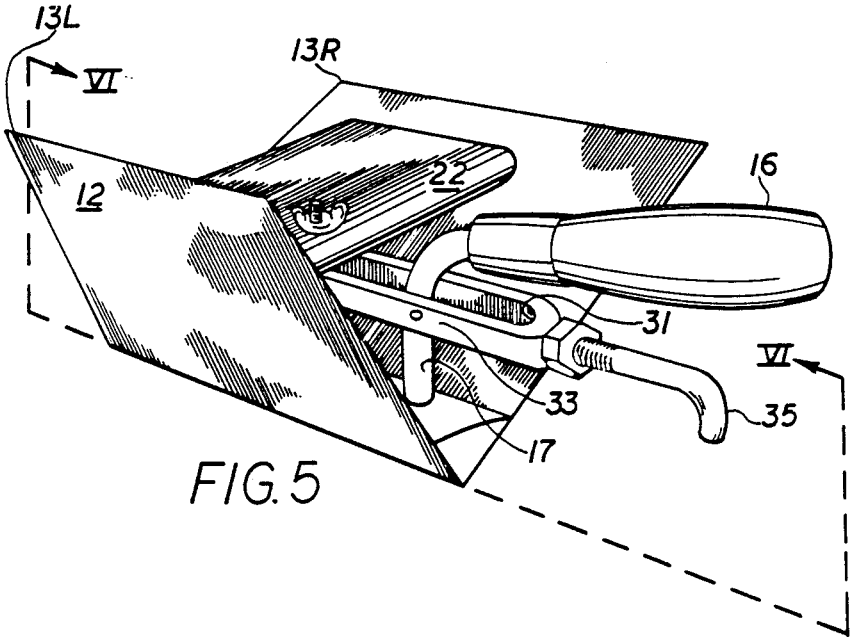
FIG. 5 is a perspective view of the rearward end of the tool showing the sides flexing mechanism.

In FIGS. 3 and 4, the manner of the pinning of the straddle block 22 to support bar 26 is better seen. The forward end of bar 26 is provided with a ring 27 through which a threaded retention bolt 28 is vertically oriented (bolt head downward) and on which a wing nut 29 is turned down to lock bar 22 against ring 27. Optionally, one or more conventional washers, like 31U and 31L, (FIG. 2) can be interposed between the lower ring and the upper wing nut so as to protect the surfaces of the block from marring. A longitudinal slot 31 is also provided within bar 26 (FIG. 5), through which the grip shaft 17 is positioned during tool assembly. Dual bore holes 32 (FIG. 6) traverse the slotted portion of bar 26 (and are aligned with bore hole not seen in shaft 17, which admits of a solid pin 33) thusly, support bar 26 can be pivoted in a limited arc by manipulation of the curved finger grip 35 provided at the rearward end of bar 26 (FIG. 6). At one end of the arc, the lift-off gap of block 22 is limited by the contact of bar 26 against mounting bracket 18. (FIG. 6) At the other end, the block 22 rests against the two upper surfaces, 19R and 19L, and is adapted to exert bias to deflect the sides outwardly as a function of the manual pressure exerted on finger grip 35.

The intermediate position for anchoring shaft 17 within bar slot 31 is predetermined by the overall length of bar 26. The ring end 27 is arranged so that when the block is secured thereon, it will exert a balanced outward bias on the tool surfaces.

In operation, when the tool is pressed against and along a right-angled corner, it is accompanied by slight squeezing pressure on the finger grip 35, so as to bias the tool sides tightly against the converging dry wall boards, this manual effort causes the forward tapered edges of the tool to trowel the sealing plaster of the joint down to a feather edge relationship with the surfaces of the corner panels of the wall structure.

Figure 7:
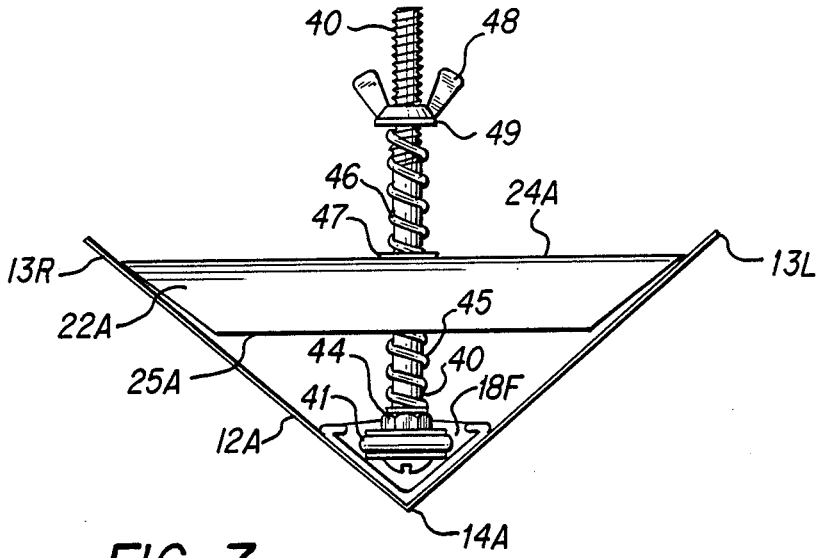
FIG. 7 is a forward end view of another embodiment of the tool showing an alternate means for maintaining the outward flare of the biasing means during use.

Referring now to the alternate embodiment of FIG. 7, in particular, there is shown another tool specially adapted for finishing inside corner joints which are formed on dry wall construction. The body, as in the first embodiment, generally 11A, comprises a sheet of flexible metal 12A. The sheet material has been preformed into the like two substantially flat sides, 13L and 13R, which are juxtaposed to one another and which extend radially from a common axis 14A to define a rather wide dihedral configuration when viewed from the forward end (FIG. 7).

Figure 8:
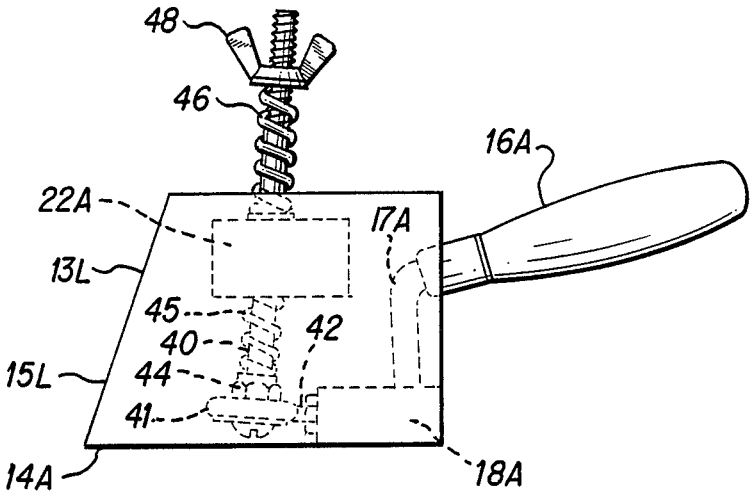
FIG. 8 is an elevational view in crosssectional taken substantially along lines IX—IX in FIG. 9.
Figure 9:
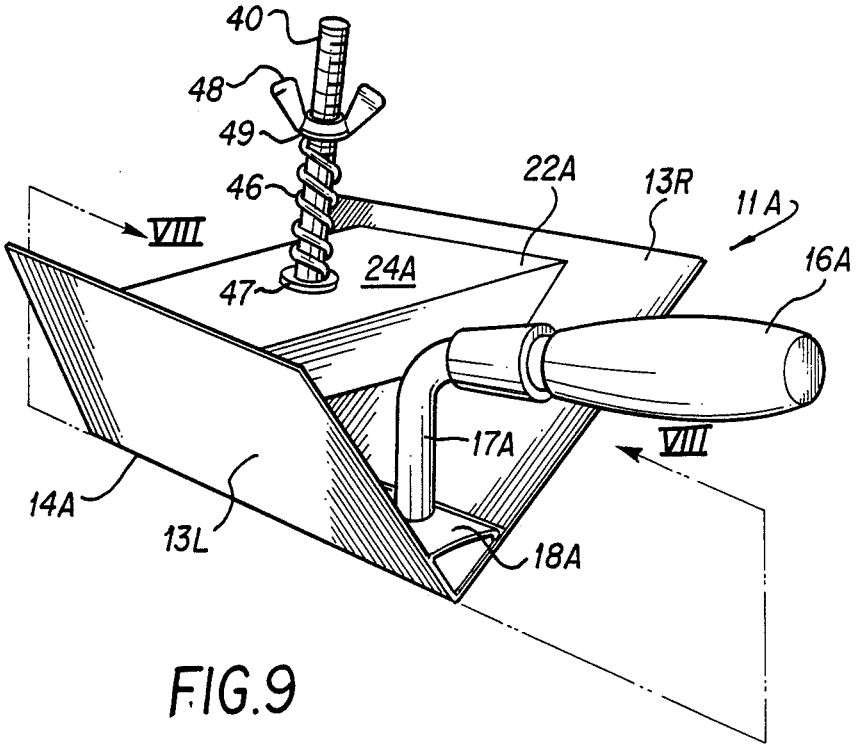
FIG. 9 is a perspective view of the rearward end of the embodiment of FIG. 7 showing the flat sides deflecting means mechanism.

In FIG. 8, as in the embodiment of FIG. 4, the side view further reveals how the forward edges 15L (and 15R) of the blade sides incline backwardly and uniformly away from the trough 14A of the tool body.

Also in FIG. 8, it will be seen that gripping means, has a handle portion 16A of polished surface joined with a rigid elbow-like shaft 17A, the vertical leg of which terminates at fixed bracket 18A. The latter seats in a fixed manner as described for the first embodiment. Grip 16A is usually disposed rearwardly on trough for achieving balanced application of wallboard corner pressure by the installer. The support bar 26 is omitted and its function accomplished differently as will be shown.

Shaft 40 is an upwardly rigid member which is disposed centrally and fixedly within the sides defined as a common axis 14A, but being located forwardly of bracket 18A which that serves to support the vertical gripping means 16A. One convenient means of supporting the vertical shaft 40 is by securing its bolt head within a ring 41, which, in turn, is secured by its shaft end 42 to the forward face 18F of the bracket 18A. Ring 41 replaces the similar ring 27 of the first described embodiment, that supports the block 22 of that embodiment, and is pivotally pinned to bar 26.

In effect, a threaded retention bolt 40, can be vertically oriented (bolt head downward) to pass upwardly through ring 41, and with suitable sizing, and modified areas of threading thereon, serve as the shaft 40 for the slidingly mounting of the block 22A. A locking nut 44 (and washer) are threaded tightly against the ring 41 to maintain the shaft 41 anchored and disposed astride the space defined by the diverging tool sides 13L and 13R, forward of bracket 18A.

Shaft 40 is thus adapted to pierce, support and position biasing block 22A, which is further adapted to be positioned vertically adjustable, but still to move reciprocally, on the shaft itself, when the tool is in use, and the sides are flexed inwardly.

On the lower portion of shaft 40, adjacent support ring 41 is positioned a first biasing means, typically a coiled spring 45, of a length and an inherent resilient strength sufficient to uphold block 22A, so that it is biased out of contact with the tool sides, when the tool is not in use. Coil 45 rests on blocking nut 44 while its upper end abuts the undersurface 25A of block 22A.

A second biasing means, typically another coil spring 46, of somewhat greater length and resilient strength, is also threaded on shaft 41 adjacent the outer surface 24A of block 22A. Spring 46 via washer 47 is intended to exert a downward bias upon block 22A, the amount of that force being dependent upon the preset depth of spring 46 on the upper shaft. The partly adjustable position of upper spring 46 is a function of how far down the shaft 41 that a spring-retaining wing nut 48, and its underlying washer 49, are located. The proper balance of the opposing springs is a matter of judgment within the skill of the plasterer to determine, how much of an initial outer flexure is needed for a specific wallboard finishing task. This tool embodiment is otherwise identical in function and purpose to the earlier described embodiment. An apparent advantage is that the workman can use all his fingers to grip and guide the tool, without diverting one or more fingers to grip and maintain bar 26(F16.4) in the desired degree of flexure.

The use of the present tool has effected considerable economy in the construction of so-called dry wall, that is, walls constructed of wall board, in that the joints or seams of the wall board panels may be expeditiously sealing paste filled and trimmed, and also, the inside corner seams can be formed with plaster in a highly expeditious manner, inasmuch as very little is left to the dexterity and skill of the installer other than to exert a sufficient pressure upon the tool to deflect the operating forward ends thereof in the manner hereinbefore described. The joints thus formed, while being substantially uniform, must follow the converging surfaces of the wall panel which form the corner structures and film of plaster which overflows from the immediate joint region onto the panel surfaces, adjacent the corner seams, and will be feather edged relative to the panel surfaces. This will eliminate most of the sanding operation heretofore found necessary before decorative media could be applied to a seamed dry wall structure.

It is to be understood that while it is preferred to provide the tool with a good grade of flexible steel, other flexible material, such as formed plastic blades, may be found satisfactory for the purposes stated.

What is claimed:

1. A wallboard corner finishing tool comprising:

(a) A body formed of a manually flexible, planar sheet material having two substantially flat sides juxtaposed and extending radially from one common axis to define a dihedral configuration set at a uniform angle from the edge thereof throughout its length, which angle is measurably greater than 90° but less than 120°;

(b) a gripping means fixed essentially centrally of the inner surfaces of the dihedral body and extending rearwardly of the back edge thereof;

(c) a tool angle flaring means adapted for biasing outwardly the flat sides of the tool to enlarge the preset angle normally defined by said flat sides, thereby to allow the sides to diverge relative to each other when the sides are flexed outwardly such that the sides may be biased tightly against converging wall boards forming a wall board corner during use;

(d) an upwardly projecting rigid shaft disposed centrally and fixedly on said common axis and also adapted to slidingly bear and retain said tool angle flaring means, which is further adapted to move reciprocably on the shaft;

(e) a first biasing means centered on said shaft and positioned between the common axis and the undersurface of the tool angle flaring means and serving to maintain said tool angle flaring means spaced apart from the flat side; and (f) a second biasing means also centered on said shaft and positioned contacting the outersurface of the tool angle flaring means and adapted to flexibly resist the inward flexing of the flat sides during their contact with wallboard seams.

2. A tool as set forth in claim 1 in which the dihedral angle of the flat sides is not less than 95°.

3. A tool as set forth in claim 1 in which the flat sides are deformable under traveling pressure.

4. A tool as set forth in claim 1 in which the flat sides are of a smooth metallic surface.

5. A tool as set forth in claim 1 in which the forward edges of the flat sides are tapered rearwardly from their common axis to their outer edges.

* * * * *

UNITED STATES PATENT AND TRADEMARK OFFICE

CERTIFICATE OF CORRECTION

PATENT NO. : 4,757,572

DATED : July 19, 1988

INVENTOR(S) : Gary Yon

It is certified that error appears in the above—identified patent and that said Letters Patent is hereby corrected as shown below:

In column 3, line 5: please insert "of" after "exertion".

In column 4, line 53: please delete "F16." and substitute "FIG." therefor.

Signed and Sealed this

Sixth Day of December, 1988

*Attest:*

*Attesting Officer*

DONALD J. QUIGG

*Commissioner of Patents and Trademarks*